US008021196B2

(12) United States Patent
Orui

(10) Patent No.: US 8,021,196 B2
(45) Date of Patent: Sep. 20, 2011

(54) MATCHING CONNECTOR

(75) Inventor: Kazuya Orui, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 12/772,542

(22) Filed: May 3, 2010

(65) Prior Publication Data

US 2010/0216348 A1 Aug. 26, 2010

Related U.S. Application Data

(63) Continuation of application No. PCT/JP2007/072314, filed on Nov. 16, 2007.

(51) Int. Cl.
*H01R 24/00* (2006.01)
*H01R 33/00* (2006.01)

(52) U.S. Cl. ..... 439/660

(58) Field of Classification Search ..... 439/660, 439/79, 74

See application file for complete search history.

(56) References Cited

U.S. PATENT DOCUMENTS 6,454,610 B1 * 9/2002 Yu ..... 439/660

FOREIGN PATENT DOCUMENTS

| | | |
|---|---|---|
| JP | 4-24626 | 6/1992 |
| JP | 4-119977 | 10/1992 |
| JP | 5-26904 | 2/1993 |
| JP | 5-121133 | 5/1993 |
| JP | 9-171861 | 6/1997 |
| JP | 2007-103189 | 4/2007 |
| TW | 200721605 | 6/2007 |

OTHER PUBLICATIONS

International Search Report for PCT/JP2007/072314, mailed Dec. 11, 2007.

Taiwanese Office issued Dec. 23, 2010 in corresponding Taiwanese Patent Application 096143523.

* cited by examiner

*Primary Examiner* — Javaid Nasri

(74) *Attorney, Agent, or Firm* — Staas & Halsey LLP

(57) ABSTRACT

A small matching connector which may prevent the occurrence of a positional deviation between male and female contacts when male and female connectors are fitted to each other and may remove foreign matter adhered to the female contacts is provided. The female contacts arranged along the inner peripheral surface of the female connector are inclined with respect to a direction perpendicular to the insertion direction of the male connector into the female connector and parallel with the longitudinal direction of the inner peripheral surface. The adjacent female contacts whose inclined surfaces are opposed to each other are paired and have the same inclination angle with respect to the inner peripheral surface.

4 Claims, 8 Drawing Sheets

MATCHING CONNECTOR

CROSS-REFERENCE TO RELATED APPLICATION

This application is a continuation application based upon and claims priority of PCT Application No. PCT/JP2007/072314, filed on Nov. 16, 2007, the contents being incorporated herein by reference.

FIELD

The embodiments discussed herein are related to a matching connector, which is a male connector having a projection fitted into a female connector having a recess.

BACKGROUND

In recent years, a substrate in an electronic device has a large number of integrated circuits with many pins, and consequently, the total number of contacts of a matching connector having a two-piece-type bellows contact to electrically connect the substrates has been increasing. The female connector of the matching connector is comprised of a housing with a parallelepiped recess, which is provided with an array of plural contacts formed on the inner peripheral surface thereof. The male connector of the matching connector is comprised of a housing with a projection, which is provided with an array of plural contacts formed on the outer peripheral surface thereof and opposed to the corresponding contacts of the female connector.

In the matching connector, the male connector is fitted into the female connector to establish a connection. Miniaturization of the connector makes it difficult to correct a positional deviation between the contacts of the male and female connectors due to the restriction of the dimensional accuracy of the housings of the connectors. Moreover, in order to increase the number of contacts while miniaturizing the connector, attempts to reduce the contact pressure of the contacts of the male and female connectors have been made.

Reduced contact pressure makes it difficult to remove dust adhered to the female connector of the matching connector due to the mutual sliding contact of the small contacts. As one solutions for removing foreign matter adhered to the contacts, Japanese Unexamined Patent publication No. 5-026904 has proposed making each contact (each contact of a male connector) in contact with each pad (each contact of a female connector) at a plurality of contact points.

However, the solution disclosed in Japanese Unexamined Patent Publication No. 5-026904 can be applied to a spring contact, but cannot be applied to removal of foreign matter in a small matching connector to which the subject of the present invention is directed. Moreover, no solutions have been proposed to correct a positional deviation of the contacts of the male and female connectors in a matching connector, caused by the miniaturization of the connector.

SUMMARY

The present application provides a matching connector which is able to prevent a positional deviation of contacts when male and female connectors of a small matching connector are fitted to each other, and which is able to remove foreign matter adhered to the female contacts.

According to the first embodiment of the present invention, there is provided a matching connector including a female connector having a housing having a space defined by a longitudinal direction, a lateral direction, and an orthogonal direction perpendicular thereto, the female connector being provided with an array of a plurality of female contacts, which are arranged on an inner peripheral surface of the space defined by the longitudinal and orthogonal directions, and a male connector having male contacts corresponding to the female contacts, that are provided on an outer peripheral surface of a projection, wherein all of the female contacts are inclined with respect a direction perpendicular to an insertion and removal direction of the male connector into and from the female connector and parallel to the longitudinal direction.

According to a second embodiment of the present invention, there is provided a matching connector including a female connector having a housing having a space defined by a longitudinal direction, a lateral direction, and an orthogonal direction perpendicular thereto, the female connector being provided with an array of a plurality of female contacts which are arranged on an inner peripheral surface of the space defined by the longitudinal and orthogonal directions, and a male connector having male contacts corresponding to the female contacts, that are provided on an outer peripheral surface of a projection, wherein a part of the female contacts is inclined with respect a direction perpendicular to an insertion and removal direction of the male connector into and from the female connector and parallel to the longitudinal direction.

Moreover, a circuit board on which a the above connector is mounted and an electronic device in which the circuit board is incorporated will be provided.

The object and advantages of the invention will be realized and attained by means of the elements and combinations particularly pointed out in the claims. It is to be understood that both the foregoing general description and the following detailed description are exemplary and explanatory and are not restrictive of the invention, as claimed.

BRIEF DESCRIPTION OF DRAWINGS

The present invention is illustrated by way of example, and not limitation, in the figures of the accompanying drawings in which like references indicate similar elements. Note that the following figures are not necessarily drawn to scale.

DESCRIPTION OF EMBODIMENTS

Before describing the embodiments, an explanation will be given of the conventional matching connector disclosed in FIGS. 1 to 2B.

Figure 1:
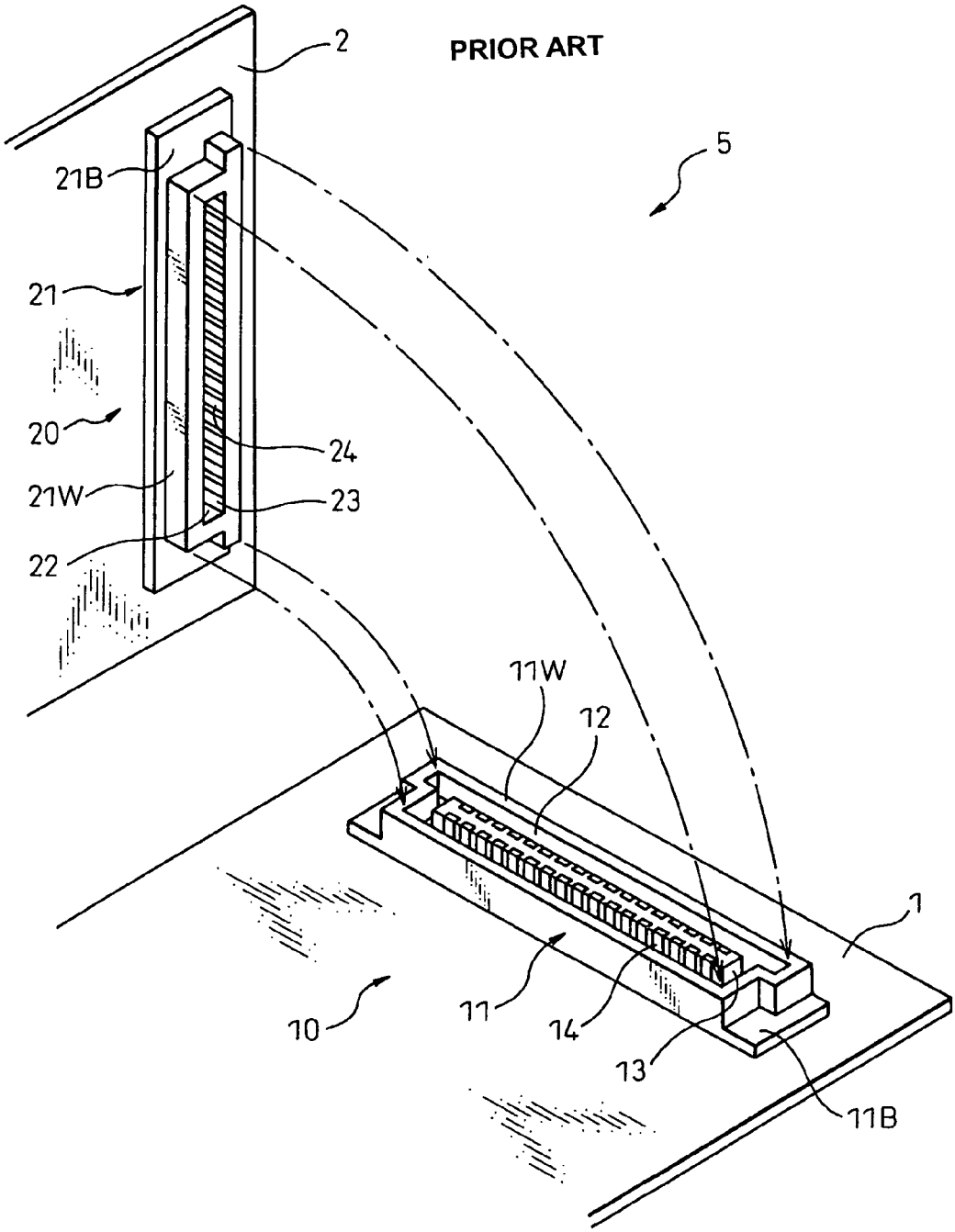
FIG.1 PRIOR ART
FIG. 1 is a perspective view illustrating the structure and fitting state of a conventional matching connector.

FIG. 1 discloses the structure of a conventional matching connector 5 and how to use it. The matching connector 5 includes a male connector 10 and a female connector 20. The male connector 10 is mounted on a circuit board 1 through pins (not illustrated), and the female connector 20 is mounted on a circuit board 2 through pins (not illustrated). The components (not illustrated) provided on the circuit boards 1 and 2 are electrically connected to each other by fitting the male connector 10 in the female connector 20 to establish an electrical connection therebetween.

The male connector 10 has a housing 11 made of a resin, which consists of a base portion 11B to be mounted to the circuit board 1 and a wall portion 11W projecting from the base portion 11B. The portion surrounded by the wall portion 11B defines a space 12 in which a wall portion 21W of the female connector 20, which will be discussed hereinafter, is inserted. A contact holder 13 having a plurality of contacts 14 protrudes in the space 12.

The female connector 20 to be connected to the male connector 10 has a housing 21 made of a resin and consists of a base portion 21B mounted to the circuit board 2 and a wall portion 21W projecting from the base portion 21B. The outer size of the wall portion 21W which is inserted in the space 12 of the male connector 10 is smaller than the space 12 of the male connector 10. The space 22 defined by the wall portion 21W of the housing 21 in the longitudinal direction, the lateral direction and in the orthogonal direction perpendicular thereto is configured to receive the contact holder 13 of the male connector 10 inserted therein. A plurality of contacts 24 are provided on the inner peripheral surface 23 of the space 22 defined in the longitudinal direction and the orthogonal direction thereof.

The plurality of contacts 24 provided on the inner peripheral surface 23 of the space 22 of the female connector 20 correspond to the contacts 14 provided on the contact holder 13 of the male connector 10. Namely, when the male connector 10 and the female connector 20 are fitted and connected to each other, the contacts 14 provided on the contact holder 13 of the male connector 10 are electrically connected to the plural contacts 24 provided on the inner peripheral surface 23 of the space 22 of the female connector 20.

Figure 2A:
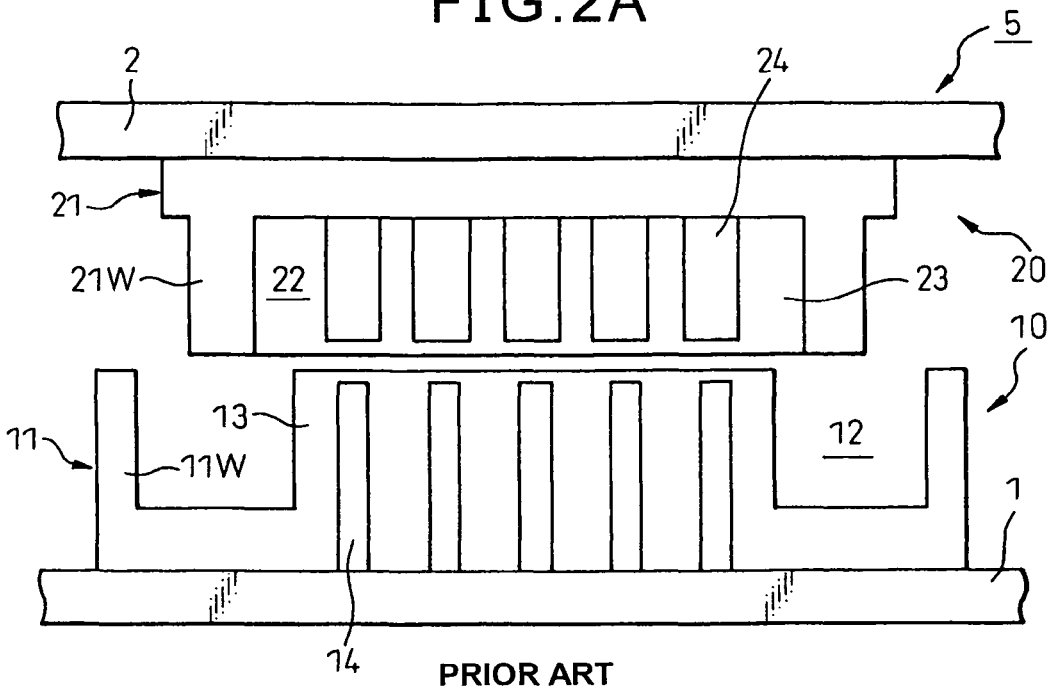
PRIOR ART FIG.2A
FIG. 2A is an explanatory view illustrating a matching connector illustrated in FIG. 1 before connectors are fitted.

FIG. 2A schematically illustrates the matching connector 5 before the male and female connectors are fitted. For the sake of clarity, FIG. 2B illustrates a smaller number of the contacts 14 of the male connector 10 and a smaller number of the contacts 24 of the female connector 20 than the actual numbers of the respective contacts and does not illustrate the sectional shape of the actual male and female connectors 10 and 20. Moreover, it is assumed that the contacts 24 of the female connector 20 in FIG. 2A is located in front of the contacts 14 of the male connector 10 with respect to the sheet of the drawing. Like reference numerals used therein represent the same components as those illustrated in FIG. 1.

Figure 2B:
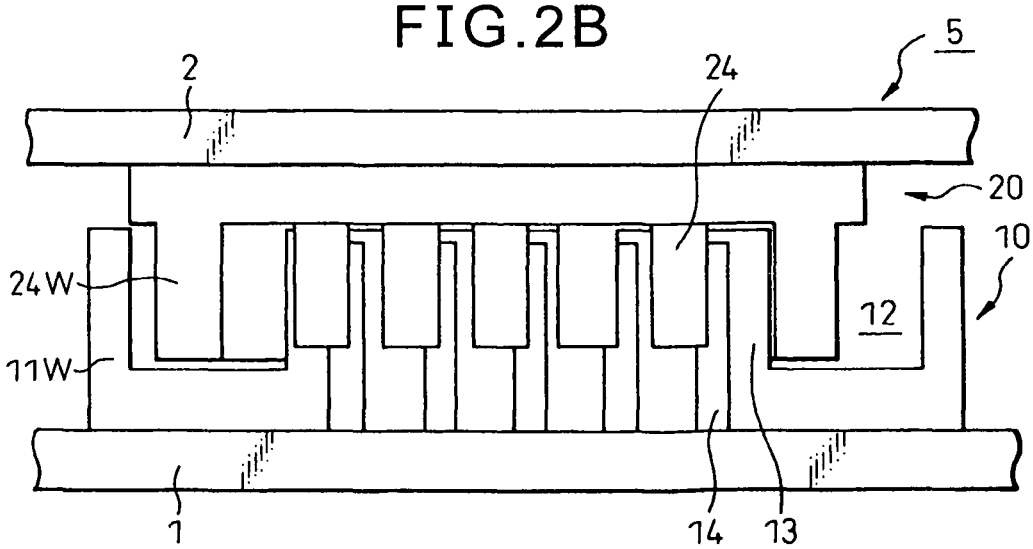
PRIOR ART FIG.2B
FIG. 2B is an explanatory view illustrating a matching connector illustrated in FIG. 2A when connectors are fitted with a positional deviation.

FIG. 2B schematically illustrates the matching connector 5 indicated in FIG. 2A when the male and female connectors are fitted with a positional deviation. As the space 12 of the male connector 10 is larger than the wall portion 21W of the female connector 20, a positional displacement of the female connector 20 from a correct connecting position to the male connector 10 may occur as illustrated in FIG. 2B when the male connector 10 is fitted to the female connector 20. If such a positional displacement occurs, the contact surface between the contacts 14 of the male connector 10 and the contacts 24 of the female connector 20 is reduced, thus resulting in failure of the electrical connection. To prevent this, if the width of each contact is increased, the adjacent contacts may short-circuit when a large positional displacement occurs.

The matching connector according to the present invention eliminates the above-mentioned drawbacks of the conventional matching connector, such as a contact failure when the male and female connectors are fitted to each other or the occurrence of a short-circuit. The mode for carrying out the present invention will be discussed below in detail with reference to the specific embodiments. Note that, for clarity, the same components as those used in the matching connector illustrated in FIGS. 1 to 2B are represented by the same reference numerals.

The embodiments of the invention will be discussed with reference to FIGS. 3A to 7. In the embodiments, for the sake of clarity, a smaller number of the contacts 14 of the male connector 10 and a smaller number of the contacts 24 of the female connector 20 than the actual numbers of the respective contacts are illustrated. Also, the components and the portions corresponding to those in FIGS. 1, 2A, and 2B are indicated with like reference numerals.

Figure 3A:
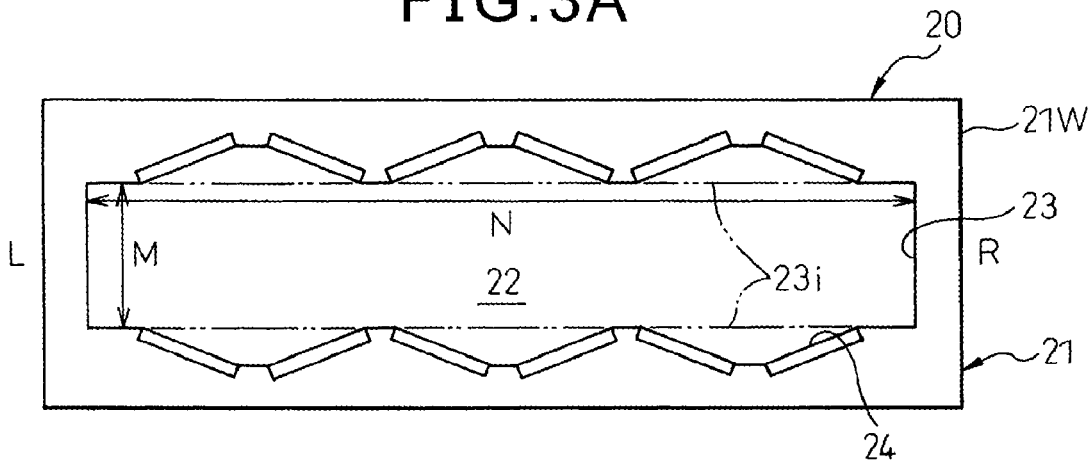
FIG. 3A is a plan view of a female connector according to a first embodiment of the invention.

FIG. 3A is a plan view of the female connector 20 according to the first embodiment of the invention. In the conventional female connector 20 illustrated in FIG. 1, the position indicated by a phantom line in FIG. 3A corresponds to the inner peripheral surface. The position indicated by the phantom line is referred to as an imaginary inner peripheral surface 23*i*. In the first embodiment, portions of the inner peripheral surface 23 on which all of the flat-shaped female contacts 24 are provided are arranged in the space 22 defined by the wall portion 21W of the housing 21 in the longitudinal direction, the lateral direction and in the orthogonal direction, along the longitudinal direction of the space 22 are inclined with respect to the imaginary inner peripheral surface 23*i*. Namely, all the female contacts 24 are inclined with respect to the direction perpendicular to the insertion and removal direction of the male connector 10 into and from the female connector 20 and the direction parallel with the imaginary inner peripheral surface 23*i* extending in the longitudinal direction. Specifically, in the first embodiment, the adjacent two female contacts 24 form a pair and the inclined surfaces in each pair are opposed to each other, and the two inclined surfaces have the same inclination angle with respect to the imaginary inner peripheral surface 23*i*. The lengths N and M of the space 22 in the longitudinal and lateral directions respectively may be identical to those of the space 22 of the conventional matching connector.

It is assumed that the female connector 20 constructed as above, according to the first embodiment of the invention is fitted to the male connector 10. For the sake of clarity, one of the longitudinal sides of the female connector 20 is referred to as side R and the other longitudinal side is referred to as side L. Also, hereinafter, the inclination angle with respect to the imaginary inner peripheral surface 23*i* is referred to simply as the inclination angle with respect to the longitudinal direction of the space 22.

Figure 3B:
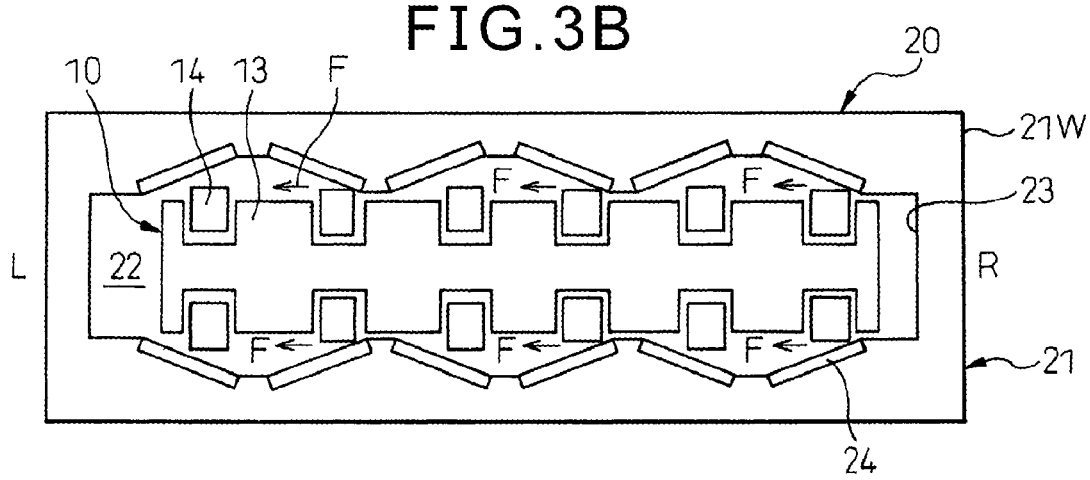
FIG. 3B is an explanatory view of a male connector which is fitted in a female connector illustrated in FIG. 3A, with a positional deviation.

In FIG. 3B, the male connector 20 is fitted to the female connector 20 with a positional deviation, in a direction toward the side R in the illustrated embodiment. Note that in FIG. 3B, only the contact holder 13 of the male connector 10 and the male contacts 14 are illustrated and the housing thereof is not illustrated.

When the male connector 10, which is deviated in the direction toward the side R from the correct position, is fitted to the female connector 20, the male contacts 14 of the contact holder 13 of the male connector 10 are brought into contact with every two inclined female contacts 24 of the female connector 20. Consequently, the male contacts 14 of the male connector 10 that abut against the female contacts 24 slide on the inclined surfaces of the female contacts 24 of the female connector 20 due to the contact pressure in the inclination direction. As a result, the male contacts 14 of the male connector 10 are moved in the direction indicated by the arrows F. This movement continues until the male contacts 14 of the male connector 10 that have not been brought into contact with the female contacts 24 abut against the female contacts 24 of the female connector 20.

Figure 3C:
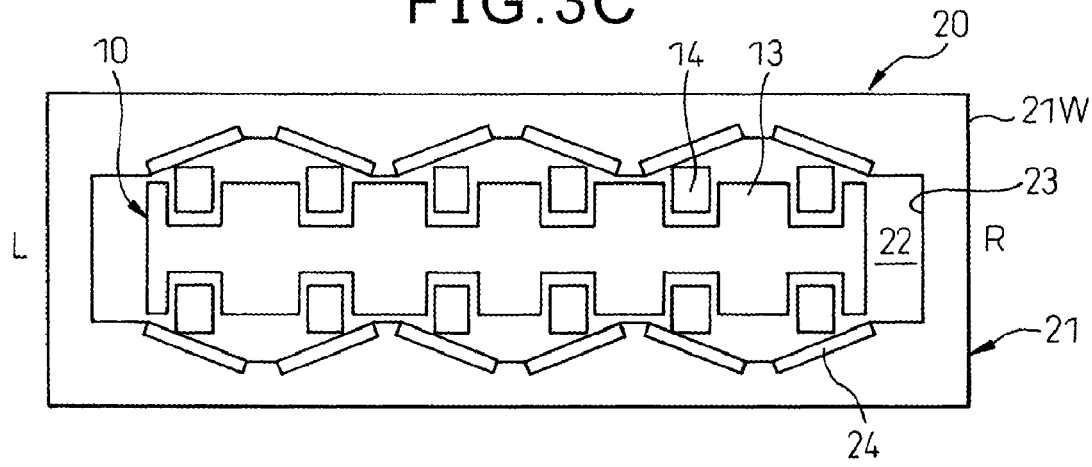
FIG. 3C is an explanatory view of a male connector whose insertion position illustrated in FIG. 3B has been corrected, so that the male connector is correctly fitted in the female connector.

The inclination angles of the inclination surfaces of the opposed female contacts 24 of the female connector 20 with respect to the longitudinal direction of the space 22 are identical to each other. Therefore, when the movement of the male contacts 14 of the male connector 10 is stopped, the two male contacts of the male connector 10 are centered and located at a median portion of the two opposed inclined surfaces of the adjacent female contacts. This centering state is illustrated in FIG. 3C.

The same is true when the position of the male connector 10 is deviated in the direction toward the side L with respect to the female connector 20 illustrated in FIG. 3A and is fitted to the female connector 20. As can be seen from the foregoing, according to the matching connector 5 of the first embodiment, the positional deviation of the male and female connectors 10 and 20 upon fitting will be prevented. Moreover, most preferably, the inclination angles of the female contacts 24 in each pair with respect to the space 22 are identical to each other, but may be slightly and irregularly different from one another. The same is true in the embodiments discussed below.

Figure 4A:
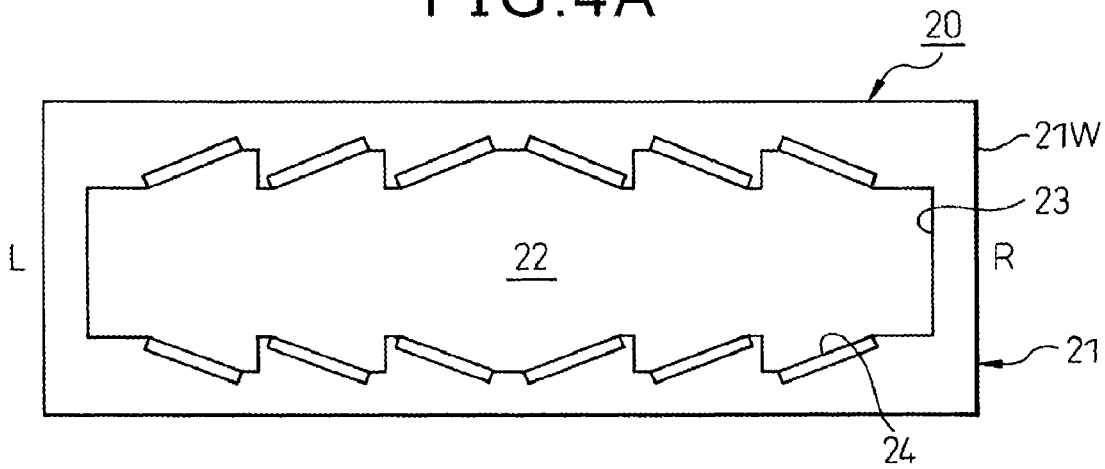
FIG. 4A is a plan view of a female connector according to a second embodiment of the invention.

FIG. 4A is a plan view of the female connector 20 according to the second embodiment. In the second embodiment, all the female contacts 24 provided on the inner peripheral surface 23 of the housing 21 are inclined at the same inclination angle in the direction perpendicular to the insertion and removal direction of the male connector into and from the female connector 20 and parallel with the longitudinal direction of the space 22.

In the second embodiment, the inclination angles of the adjacent female contacts 24 on one of the sides (side L) with respect to the median portion of the female connector 20 are identical to each other. The adjacent female contacts 24 on the other side (side R) with respect to the median portion of the female connector 20 are inclined at the same angle in the same direction opposite to the inclination direction of the female contacts 24 on the side L.

When the male connector 10 whose position is deviated, for example, in the direction toward the side R with respect to the female connector 20 is fitted to the female connector 20, the mode of operation to correct the positional deviation is the same as that in the first embodiment mentioned above. Namely, in the second embodiment, the male contacts 14 of the male connector 10 that are located on the right half of the male connector adjacent to the side R are brought into contact with the inclined female contacts 24 of the female connector 20.

As a result, the male contacts 14 of the male connector 10 that abut against the female contacts 24 slide and move on and along the inclined surfaces of the female contacts 24 of the female connector 20 due to the contact pressure in the inclination direction. This sliding movement continues until the male contacts 14 of the male connector 10 that have not been in contact with the female contacts 24 and that are located on the left half of the male connector adjacent to the side L are brought into contact with the female contacts 24. Thus, the male connector 10 is correctly positioned relative to the female connector 20.

When the male connector 10 is fitted to the female connector 20 with a positional deviation, the movement of the male contacts 14 of the male connector 10 on and along the female contacts 24 of the female connector 20 occurs. Therefore, foreign matter adhered to the female contacts 24 of the female connector 20, if any, is also moved in the inclination direction in accordance with the movement of the male contacts 14 of the male connector 10 and thus is removed from the female contacts.

Figure 4B:
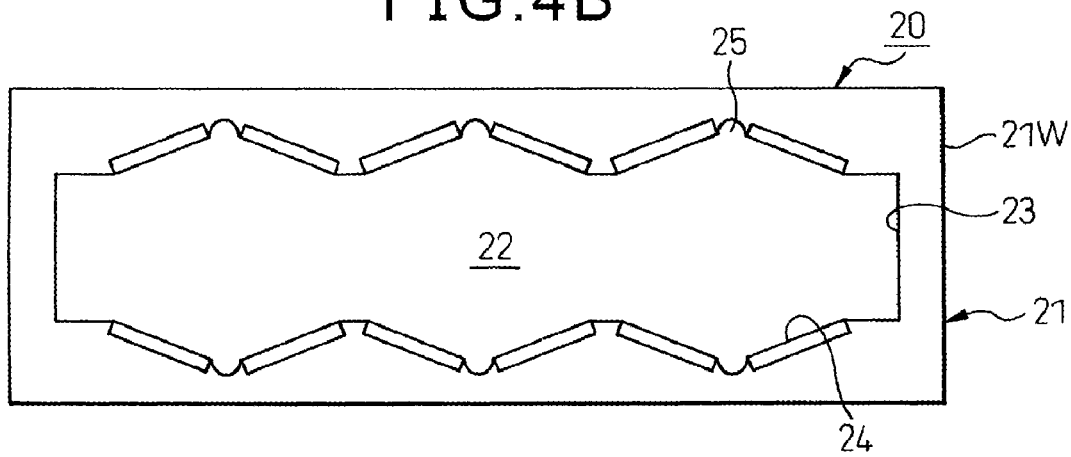
FIG. 4B is a plan view of a female connector according to a third embodiment of the invention.

FIG. 4B illustrates the female connector 20 according to the third embodiment. The female connector 20 according to the third embodiment corresponds to a variant of the first embodiment illustrated in FIG. 3A and is provided with pairs of female contacts 24, each consisting of two adjacent female contacts opposed to each other and recesses 25 which are provided between the two adjacent inclined surfaces of the female contacts in each pair to receive therein foreign matter mentioned above. The shape of the recesses 25 is not limited to that in the third embodiment.

Figure 4C:
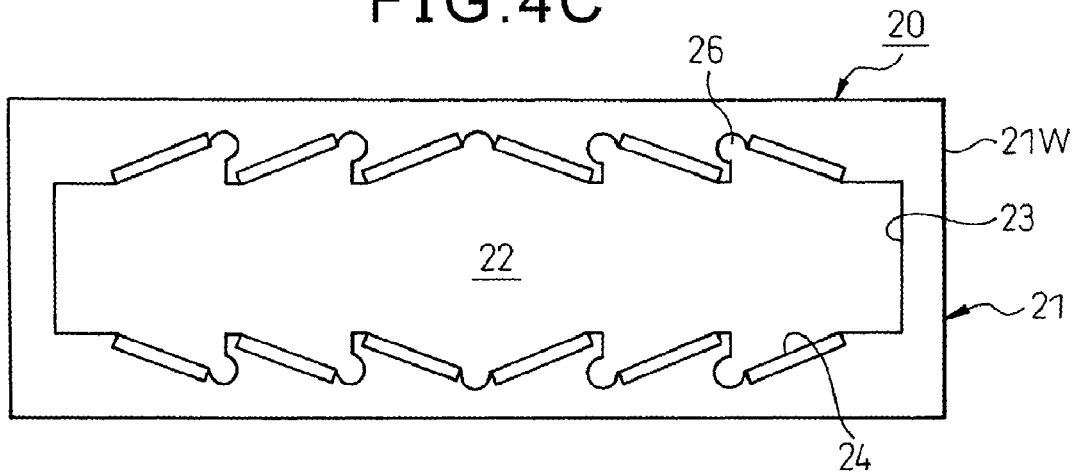
FIG. 4C is a plan view of a female connector according to a fourth embodiment of the invention.

FIG. 4C illustrates the female connector 20 according to the fourth embodiment. The female connector 20 according to the fourth embodiment is a variant of the second embodiment illustrated in FIG. 4A and is provided with recesses 26, each formed in the peripheral surface 23 between the two adjacent female contacts 24 to receive therein foreign matter. The shape of the recesses 26 is not limited to that in the fourth embodiment.

Figure 5A:
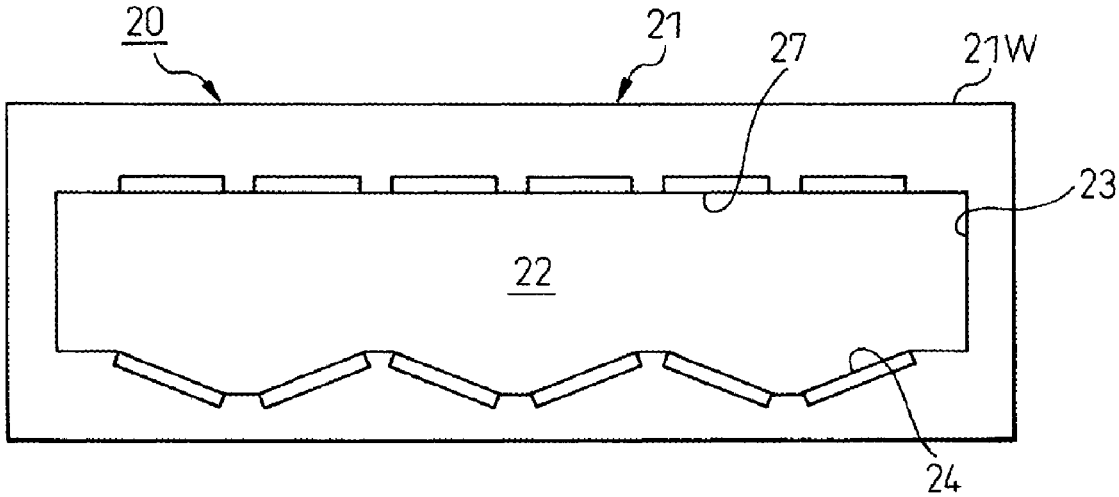
FIG. 5A is a plan view of a female connector according to a fifth embodiment of the invention.

FIG. 5A illustrates the female connector 20 according to the fifth embodiment, which is a variant of the first embodiment illustrated in FIG. 3A. As in the first embodiment, all of the female contacts 24 arranged in the space 22 of the housing 21 are inclined at the same inclination angle with respect to the direction perpendicular to the insertion and removal direction of the male connector 10 into and from the female connector 20 and parallel with the longitudinal direction of the space 22.

In the fifth embodiment, the female contacts 24 arranged along one of two opposite surfaces of the space 22 of the female connector 20 in the longitudinal direction side are inclined, but the female contacts 27 arranged along the other surface of the space are configured to have the same shape as the prior art without being inclined. The female connector 20 according to the fifth embodiment has the same function as the female connector 20 according to the first embodiment. In the fifth embodiment, it is possible to provide the recesses 25 in the inner peripheral surface 23 between the adjacent female contacts 24 opposed to each other, as in the third embodiment.

Figure 5B:
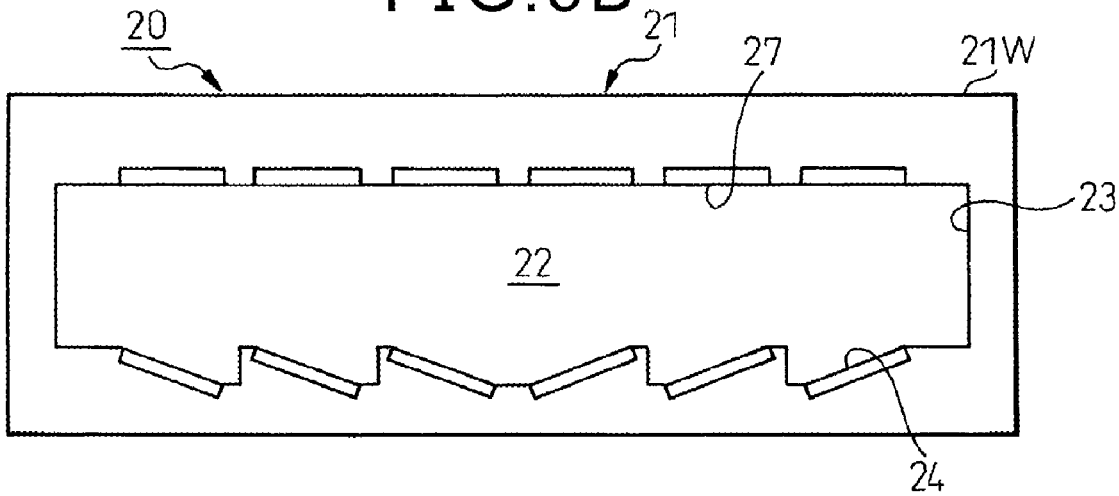
FIG. 5B is a plan view of a female connector according to a sixth embodiment of the invention.

FIG. 5B illustrates the female connector 20 according to the sixth embodiment. The female connector 20 according to the sixth embodiment is a variant of the female connector 20 according to the second embodiment illustrated in FIG. 4A. It may be recalled that in the second embodiment, all of the female contacts 24 arranged in the space 22 of the housing 21 are inclined at the same angle with respect to the direction perpendicular to the insertion and removal direction of the male connector into and from the female connector 20 and parallel with the longitudinal direction of the space 22.

In the sixth embodiment, the female contacts 24 arranged along one of two opposite surfaces of the space 22 of the female connector 20 in the longitudinal direction are inclined but the female contacts 27 arranged along the other longitudinal surface of the space 22 are configured to have the same shape as the prior art without being inclined. The female connector 20 according to the sixth embodiment has the same function as the female connector 20 according to the second embodiment. In the sixth embodiment, it is also possible to provide the recesses 26 in the inner peripheral surface 23 between the adjacent female contacts 24.

Figure 6:
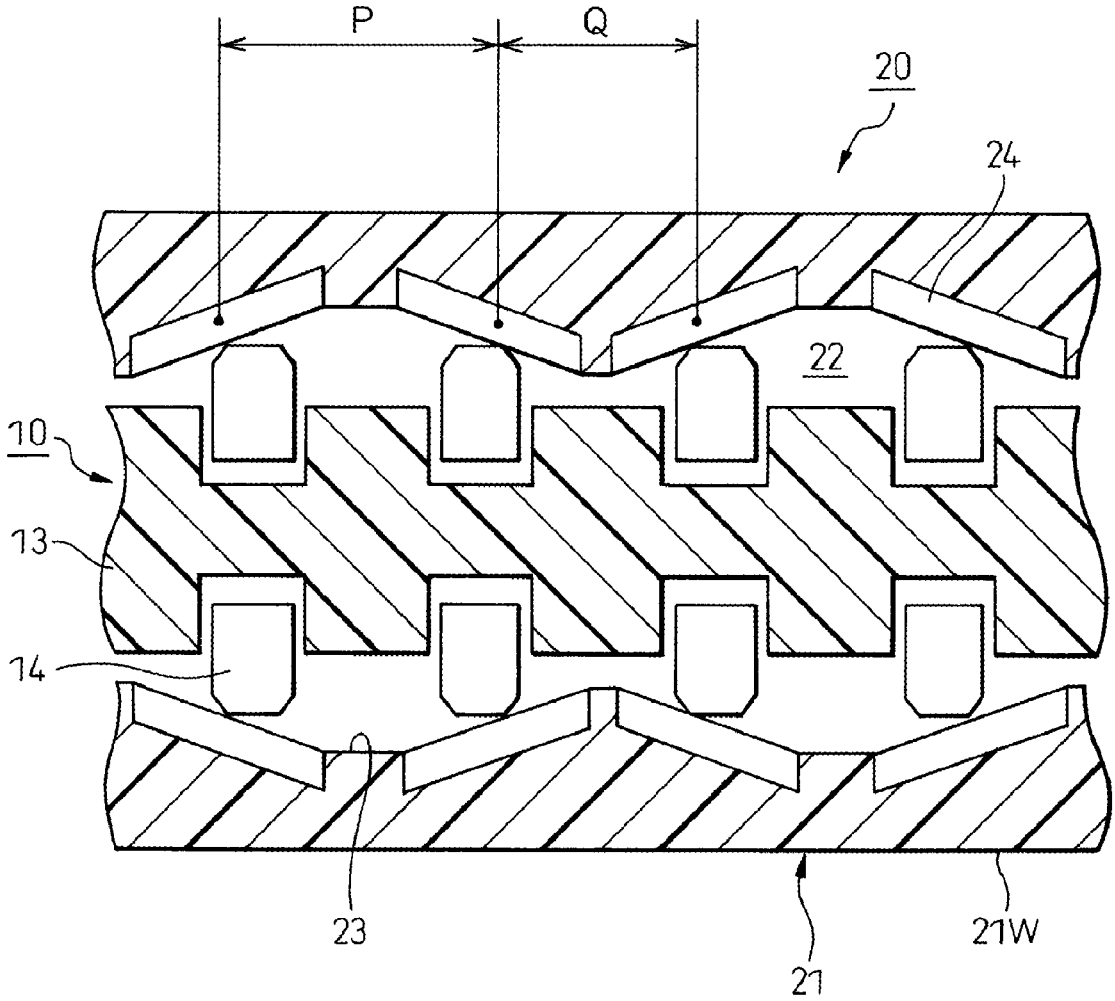
FIG. 6 is an enlarged partial sectional view of a female connector according to a seventh embodiment of the invention, in which the distance between the adjacent contacts whose inclined surfaces are opposed to each other is greater than the distance between the adjacent contacts whose inclined surfaces are inclined in opposite directions, in the first embodiment illustrated in FIG. 3A, the third embodiment illustrated in FIG. 4B and in the fifth embodiment illustrated in FIG. 5A.

FIG. 6 illustrates the seventh embodiment of the invention which may be applied to the first embodiment illustrated in FIG. 3A, the third embodiment illustrated in FIG. 4B, and to the fifth embodiment illustrated in FIG. 5A. FIG. 6 is an enlarged partial view of the first embodiment illustrated in FIG. 3A. In the seventh embodiment, the distance P between the adjacent female contacts 24 whose inclined surfaces are opposed to each other is greater than the distance Q between the adjacent female contacts 24 whose surfaces are inclined in opposite directions.

Due to the fact that the distance P between the adjacent female contacts 24 whose inclined surfaces are opposed to each other is greater than the distance Q between the adjacent female contacts 24 whose surfaces are inclined in opposite directions, it is possible to prevent the male contacts 14 provided on the contact holder 13 of the male connector 10 from bridging and contacting both the adjacent female contacts 24 of the female connector 20. Thus, no short-circuit of the adjacent female contacts 24 of the female connector 20 takes place.

Figure 7A:
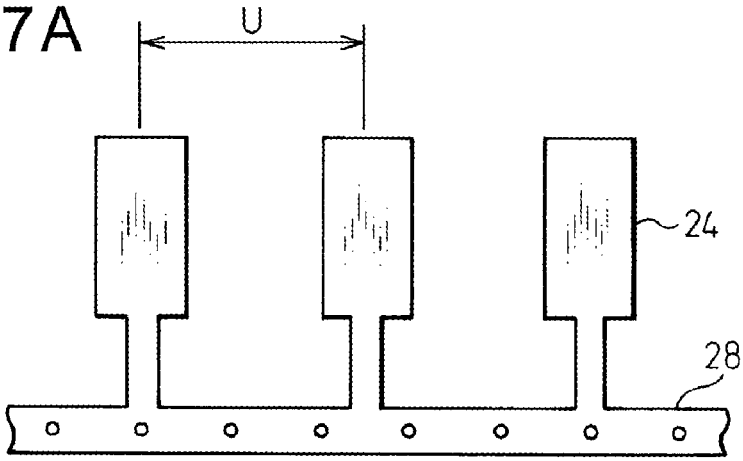
FIG. 7A is a front elevational view of contacts of a female connector provided on a carrier.

FIGS. 7A to 7F illustrate the manufacturing process of the female connector 20 with the female contacts 24 whose inclined surfaces are opposed to each other, according to the seventh embodiment. The female contacts 24. The female connector 20 may be manufactured by an insert molding which is per se known. FIG. 7A illustrates the female contacts 24 which are used for the female connector 20 and which are connected by a carrier 28. The female contacts 24 with the carrier 28 may be obtained by punching a copper plate. In this state, the female contacts 24 and the carrier 28 lie in the same plane, and the distance U between the adjacent female contacts 24 is equal to a sum of the distances P and Q indicated in FIG. 6.

Figure 7B:
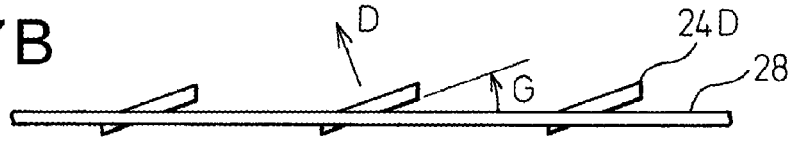
FIG. 7B is a front elevational view of contacts of a female connector illustrated in FIG. 7A, in which the contacts are bent in the same direction at the same angle.
Figure 7C:
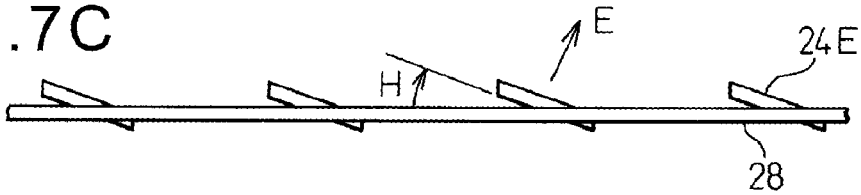
FIG. 7C is a front elevational view of contacts of a female connector illustrated in FIG. 7A, in which the contacts are bent at the same angle in the direction opposite to the direction illustrated in FIG. 7B.

FIG. 7B illustrates the female contacts 24 illustrated in FIG. 7A, which are bent in the same direction D at the same angle G with respect to the carrier 28. The female contacts 24 which are bent in the same direction D are referred to as female contacts 24D. FIG. 7C illustrates the female contacts 24 illustrated in FIG. 7A, which are bent in the same direction E at the same angle H with respect to the carrier 28. The angles G and H are identical to each other but are different in direction. The female contacts 24 which are bent in the same direction E are referred to as female contacts 24E.

Figure 7D:
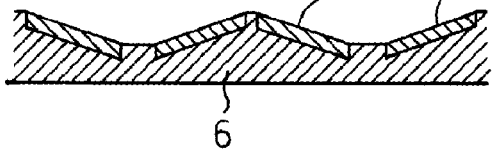
FIG. 7D is an explanatory view of contacts illustrated in FIGS. 7B and 7C, set in an insert molding die.
Figure 7E:
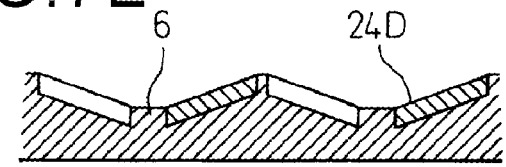
FIG. 7E is an explanatory view of contacts illustrated in FIG. 7B, which are press-fitted in an insert molding die.
Figure 7F:
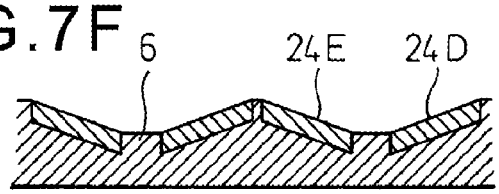
FIG. 7F is an explanatory view of contacts illustrated in FIG. 7E, in which contacts illustrated in FIG. 7C are press-fitted in an insert molding die.

FIG. 7D illustrates the female contacts 24D illustrated in FIG. 7B and the female contacts 24E illustrated in FIG. 7C, which are both placed on an insert molding die 6. When the insert molding die 6 on which the female contacts 24D and 24E are placed is filled with a resin, the female connector 20 as illustrated in FIG. 6 is obtained. Note that regarding the female contacts 24D illustrated in FIG. 7B and the female contacts 24E illustrated in FIG. 7C, it is also possible to press-fit the female contacts 24D illustrated in FIG. 7B in the insert molding die 6, as illustrated in FIG. 7E, and then, to press-fit the female contacts 24E illustrated in FIG. 7C in the insert molding die 6, as illustrated in FIG. 7E, and thereafter, to fill a resin in the insert molding die 6.

Figure 8:
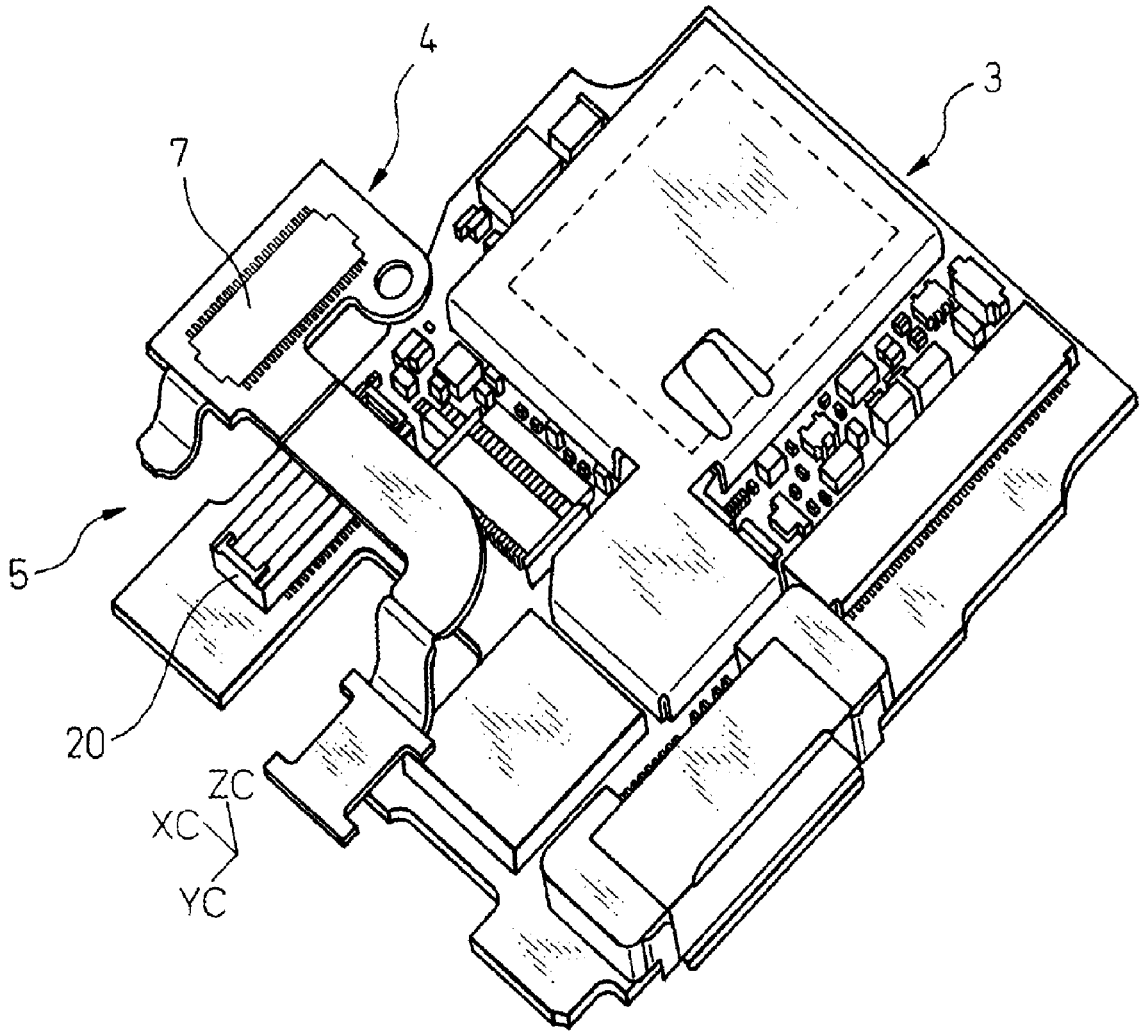
FIG. 8 is a perspective view illustrating the connection of a circuit board on which a matching connector is mounted, and a flexible circuit board on which a matching connector is mounted.

FIG. 8 illustrates a circuit board 3 on which the matching connector 5 is mounted and a flexible circuit board 4 on which the matching connector 5 is mounted and which is to be connected to the circuit board 3. In this example, the female connector 20 is mounted on the circuit board 3 on which a large number of circuit components are mounted, and the male connector 10 (not illustrated in FIG. 8) is mounted on the rear side of the flexible circuit board 4 which is provided on its front side, with an LSI 7.

According to the structure of the matching connector 5 as mentioned above, the circuit board 3 and the flexible circuit board 4 wherein the male connector 10 and the female connector 20 are fitted in a correct fitting position are incorporated and used in an electronic apparatus.

According to the matching connector proposed by the present application, it is possible not only to prevent the occurrence of a positional deviation between the male and female contacts in the small matching connector when the male and female connector are fitted to each other, but also to remove foreign matter adhered to the female contact.

Note that the total number of the terminals of the matching connector is ten, and accordingly, all of the female contacts of the female connector or all of the female contacts located on only one of the two sides are inclined in the illustrated embodiments discussed above, but if the total number of the female contacts is large, it may not incline all the female contacts. For instance, in an alternative embodiment, only the female contacts which are located close to the female connector end may be inclined and the female contacts located in the vicinity of the center portion may not be inclined, taking into consideration the fact that when the male and female connectors are fitted to each other, one of the ends of the male and female connectors tend to fit before the other ends.

Although only exemplary embodiments have been described in detail above, those skilled in the art will readily appreciate that many modifications are possible in the exemplary embodiments without departing from the novel teachings and advantages of this invention. Accordingly, all such modifications are intended to be included within the scope of this application.

What is claimed is:

1. A matching connector comprising:

a female connector having a housing, an array of a plurality of female contacts being provided on an inner peripheral surface of the housing, each of the female contacts having a flat surface; and a male connector having a projection, a plurality of male contacts being provided on an outer peripheral surface of the projection, the male contacts corresponding to the female contacts, wherein the inner peripheral surface of the housing has a plurality of inclined surfaces, each of the inclined surfaces being inclined with respect to a direction perpendicular to an insertion and removal direction of the male connector into and from the female connector and parallel to a longitudinal direction, each of the female contacts being provided on one of the inclined surfaces.

2. A matching connector according to claim 1, wherein two adjacent female contacts are paired, so that the female contacts in each pair are provided on inclined surfaces which are opposed to each other and inclined at a same inclination angle with respect to the longitudinal direction.

3. A circuit board on which a male or female connector of a matching connector is mounted, wherein the matching connector comprises:

a female connector having a housing, an array of a plurality of female contacts being provided on an inner peripheral surface of the housing, each of the female contacts having a flat surface; and a male connector having a projection, a plurality of male contacts being provided on an outer peripheral surface of the projection, the male contacts corresponding to the female contacts, wherein the inner peripheral surface of the housing has a plurality of inclined surfaces, each of the inclined surfaces being inclined with respect to a direction perpendicular to an insertion and removal direction of the male connector into and from the female connector and parallel to a longitudinal direction, each of the female contacts being provided on one of the inclined surfaces.

4. An electronic apparatus having therein a circuit board on which a male or female connector of a matching connector is mounted, wherein the matching connector comprises:

a female connector having a housing, an array of a plurality of female contacts being provided on an inner peripheral surface of the housing, each of the female contacts having a flat surface; and a male connector having a projection, a plurality of male contacts being provided on an outer peripheral surface of the projection, the male contacts corresponding to the female contacts, wherein the inner peripheral surface of the housing has a plurality of inclined surfaces, each of the inclined surfaces being inclined with respect to a direction perpendicular to an insertion and removal direction of the male connector into and from the female connector and parallel to a longitudinal direction, each of the female contacts being provided on one of the inclined surfaces.

* * * * *